US006597175B1

(12) United States Patent
Brisco

(10) Patent No.: US 6,597,175 B1
(45) Date of Patent: Jul. 22, 2003

(54) ELECTROMAGNETIC DETECTOR APPARATUS AND METHOD FOR OIL OR GAS WELL, AND CIRCUIT-BEARING DISPLACEABLE OBJECT TO BE DETECTED THEREIN

(75) Inventor: David P. Brisco, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/391,124

(22) Filed: Sep. 7, 1999

(51) Int. Cl.[7] ..... G01V 3/08
(52) U.S. Cl. ..... 324/326
(58) Field of Search ..... 324/207.16, 207.19, 324/207.22, 225, 226, 234, 236, 207.17, 259, 67, 326, 329; 166/255, 250.04; 340/603–625

(56) References Cited

U.S. PATENT DOCUMENTS

| | | | | |
|---|---|---|---|---|
| 2,999,557 A | | 9/1961 | Smith et al. | 367/181 |
| 3,116,452 A | | 12/1963 | Schmidt | 324/40 |
| 3,715,539 A | * | 2/1973 | Silberg et al. | 200/84 C |
| 3,868,565 A | * | 2/1975 | Kuipers | 364/559 |
| 3,878,453 A | | 4/1975 | Potter et al. | 324/3 |
| 4,499,955 A | | 2/1985 | Campbell et al. | 175/46 |
| 4,570,718 A | | 2/1986 | Adams, Jr. | 166/369 |
| 4,578,675 A | | 3/1986 | MacLeod | 340/855 |
| 4,617,960 A | | 10/1986 | More | 137/554 |
| 4,621,264 A | * | 11/1986 | Yashiro et al. | 324/124 |
| 4,638,278 A | | 1/1987 | Bullock | 335/207 |
| 4,642,786 A | * | 2/1987 | Hansen | 364/559 |
| 4,694,283 A | | 9/1987 | Reeb | 340/572 |
| 4,698,631 A | | 10/1987 | Kelly, Jr. et al. | 340/853.1 |
| 4,739,325 A | | 4/1988 | MacLeod | 340/854 |

FOREIGN PATENT DOCUMENTS

| | | | | |
|---|---|---|---|---|
| EP | 5 553 908 A2 | | 8/1993 | E21B/47/12 |
| EP | 0 636 763 A2 | | 2/1995 | E21B/47/12 |
| EP | 0 773 345 A1 | | 5/1997 | E21B/47/16 |
| EP | 0 882 871 A2 | | 12/1998 | E21B/47/12 |
| EP | 0 913 553 A1 | | 5/1999 | E21B/33/16 |
| GB | 2 104 665 A | | 3/1983 | G01B/7/26 |
| GB | 2247904 A | * | 3/1992 | E21B/17/00 |
| GB | 2 323 109 A | | 9/1998 | E21B/47/12 |
| JP | 410078320 A | * | 3/1998 | G01C/7/06 |
| WO | WO 92/05533 | | 4/1992 | G09F/3/00 |

*Primary Examiner*—N. Le
*Assistant Examiner*—Reena Aurora
(74) *Attorney, Agent, or Firm*—John W. Wustenberg; E. Harrison Gilbert, III

(57) ABSTRACT

An object to be displaced in an oil or gas well includes a body that is movable through a conduit of an oil or gas well and an electrical circuit that is connected to the body. The electrical circuit can include an active or passive radio frequency identification tag, at least the passive type of which is responsive to an externally generated alternating current electromagnetic signal such that the electrical circuit transmits a responsive signal for reception outside the object as the object moves through the conduit. A detector apparatus for an oil or gas well generally comprises: a body movable through a conduit of an oil or gas well; an electrical circuit connected to the body, the electrical circuit for transmitting an electromagnetic signal for reception away from the body as the body moves through the conduit; and a receiver disposed relative to the conduit and the body to receive the electromagnetic signal from the electrical circuit. The apparatus can further comprise a transmitter disposed relative to the conduit and the body to transmit into the conduit an alternating current electromagnetic signal, wherein the electrical circuit transmits its electromagnetic signal in response to the alternating current electromagnetic signal from the transmitter. Related methods are also described.

(List continued on next page.)

20 Claims, 3 Drawing Sheets

U.S. PATENT DOCUMENTS

| | | | | | |
|---|---|---|---|---|---|
| 4,790,380 | A | | 12/1988 | Ireland et al. | 166/250 |
| 4,792,790 | A | | 12/1988 | Reeb | 340/572 |
| 4,835,524 | A | | 5/1989 | Lamond et al. | 340/572 |
| 4,851,815 | A | | 7/1989 | Enkelmann | 340/571 |
| 4,857,851 | A | | 8/1989 | Anderson et al. | 324/326 |
| 4,968,978 | A | | 11/1990 | Stolarczyk | 340/854 |
| 4,990,891 | A | | 2/1991 | Reeb | 340/572 |
| 5,008,664 | A | | 4/1991 | More et al. | 340/854 |
| 5,132,904 | A | | 7/1992 | Lamp | 364/422 |
| 5,160,925 | A | | 11/1992 | Dailey et al. | 340/853.3 |
| H1132 | H | * | 1/1993 | Hellyar et al. | 367/128 |
| 5,188,183 | A | | 2/1993 | Hopmann et al. | 166/387 |
| 5,202,680 | A | | 4/1993 | Savage | 340/853.1 |
| 5,252,918 | A | * | 10/1993 | VanBerg et al. | 324/207.19 |
| 5,257,530 | A | | 11/1993 | Beattie et al. | 73/61.75 |
| 5,268,683 | A | | 12/1993 | Stolarczyk | 340/854.4 |
| 5,323,856 | A | | 6/1994 | Davis et al. | 166/253 |
| 5,348,492 | A | | 9/1994 | Sonnet | 439/194 |
| 5,363,094 | A | | 11/1994 | Staron et al. | 340/854.6 |
| 5,443,122 | A | * | 8/1995 | Brisco | 166/285 |
| 5,469,155 | A | | 11/1995 | Archambeault et al. | 340/853.4 |
| 5,477,921 | A | | 12/1995 | Tollefsen | 166/250.13 |
| 5,500,611 | A | | 3/1996 | Popat et al. | 326/87 |
| 5,504,903 | A | | 4/1996 | Chen et al. | 395/700 |
| 5,522,458 | A | * | 6/1996 | Watson et al. | 166/202 |
| 5,531,270 | A | | 7/1996 | Fletcher et al. | 166/53 |
| 5,706,896 | A | | 1/1998 | Tubel et al. | 166/313 |
| 5,960,883 | A | | 10/1999 | Tubel et al. | 166/313 |
| 5,971,072 | A | | 10/1999 | Huber et al. | 166/297 |
| 6,105,690 | A | | 8/2000 | Biglin, Jr. et al. | 175/48 |
| 6,151,961 | A | | 11/2000 | Huber et al. | 73/152.54 |

* cited by examiner

ELECTROMAGNETIC DETECTOR APPARATUS AND METHOD FOR OIL OR GAS WELL, AND CIRCUIT-BEARING DISPLACEABLE OBJECT TO BE DETECTED THEREIN

BACKGROUND OF THE INVENTION

This invention relates generally to detecting when an object moves in an oil or gas well. In a particular application, the invention relates to electronically indicating when a cementing plug has been displaced out of a plug container.

One method of detecting when a cementing plug has left the plug container includes using a mechanical flipper mechanism. The flipper extends out into the plug container below the plug. When the plug is released and drops or is displaced downward, it contacts the flipper, causing the flipper to rotate downward into a slot machined in the plug container. The flipper is connected to a shaft, which moves with the flipper. An indicator is attached to one end of the shaft on the outside of the plug container. This indicator moves with the shaft and the flipper, giving an external indication that the cementing plug has moved past the flipper.

There are shortcomings with this flipper-type indicator. If it is not cleaned periodically, the flipper becomes cemented in place. This renders it useless if it is in the slot, and this prevents the cementing plug from being displaced down the casing if the flipper is cemented in the extended position.

Electronic methods of indicating when the plug has left the plug container would not have the aforementioned mechanical shortcoming of becoming cemented; however, I am not aware of a commercially successful electronic method for detecting displacement of a cementing plug.

From the foregoing, there is still the need for an improved apparatus and method for indicating when an object moves in an oil or gas well. This is specifically applicable to determining whether a cementing plug has displaced from its plug container. There is also the need for an improved object, including a cementing plug, which enables such detection to occur.

SUMMARY OF THE INVENTION

The present invention overcomes the above-noted and other shortcomings of the prior art by providing a novel and improved apparatus and method for detecting an object moving in a conduit of an oil or gas well. The present invention also provides a novel and improved object which can be displaced in an oil or gas well and which enables the displacement to be detected.

One embodiment of the object to be displaced in an oil or gas well as provided by the present invention comprises a body movable through a conduit of an oil or gas well and an electrical circuit connected to the body, wherein the electrical circuit is responsive to an externally generated alternating current electromagnetic signal such that the electrical circuit transmits a responsive signal for reception outside the object as the object moves through the conduit. The object can also be defined to comprise a body movable through a conduit of an oil or gas well and an active or passive radio frequency identification tag electrical circuit connected to the body.

Detector apparatus for an oil or gas well as provided by the present invention generally comprises: a body movable through a conduit of an oil or gas well; an electrical circuit connected to the body, the electrical circuit for transmitting an electromagnetic signal for reception away from the body as the body moves through the conduit; and a receiver disposed relative to the conduit and the body to receive the electromagnetic signal from the electrical circuit. In particular implementations, the body is selected from the group consisting of a movable plug, ball and dart. The receiver can include an antenna mounted through the conduit. The detector apparatus can further comprise a transmitter disposed relative to the conduit and the body to transmit into the conduit an alternating current electromagnetic signal, wherein the electrical circuit transmits its electromagnetic signal in response to the alternating current electromagnetic signal from the transmitter.

The present invention also provides a method of detecting an object moving in a conduit of an oil or gas well. The method comprises: providing a triggering electromagnetic signal from outside an object moving in a conduit of an oil or gas well; generating, from an electrical circuit on the object moving in the conduit responding to the triggering electromagnetic signal, a responsive electromagnetic signal; and detecting the responsive electromagnetic signal away from the moving object.

The present invention can also be defined as a method of detecting a plug moving in a plug container of an oil or gas well, comprising: generating an electromagnetic signal from an electrical circuit on the plug moving in the plug container; and detecting the electromagnetic signal away from the moving plug.

Therefore, from the foregoing, it is a general object of the present invention to provide a novel and improved apparatus and method for detecting an object moving in a conduit of an oil or gas well. It is also a general object of the present invention to provide a novel and improved object which can be displaced in an oil or gas well and which enables the displacement to be detected. Other and further objects, features and advantages of the present invention will be readily apparent to those skilled in the art when the following description of the preferred embodiments is read in conjunction with the accompanying drawings.

DETAILED DESCRIPTION OF THE INVENTION

Figure 1:
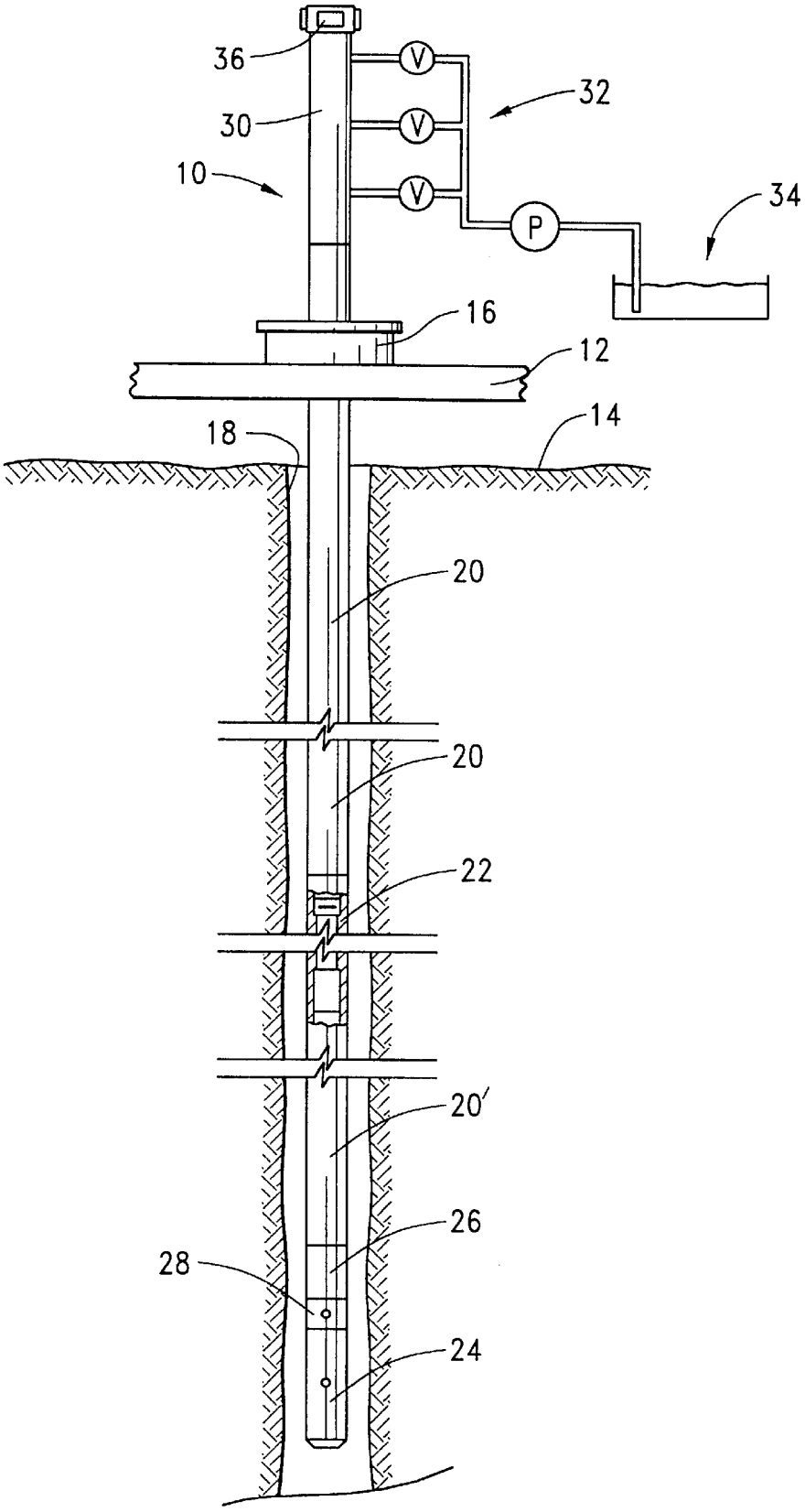
FIG. 1 is a schematic representation of a portion of an oil or gas well having apparatus in accordance with the present invention.

Referring to FIG. 1, there is illustrated part of a drilling rig 10 represented as comprising a floor 12 and a rotary table 16. The rotary table 16 carries a bushing and slips (not shown) for suspending a pipe or tubing string 20 (the term "tubing" or "tubing string" as used herein and in the claims encompasses any tubular element, whether typically referred to as "pipe" or "tubing" or "casing" or "liner" or otherwise, used in association with an oil or gas well and any string of interconnected such elements). The tubing string 20 extends downward into a borehole 18 of an oil or gas well and in at least one embodiment is comprised of a plurality of joints of tubing threaded end to end. The tubing string 20 can also include an out-of-hole extension of a casing or liner to be cemented into the borehole of the well (i.e., one or more tubular sections connected to and extending above the casing or liner in the borehole). Any such "tubing string" is included in the broader term "conduit" as used herein and in the claims, which "conduit" also includes wellhead fixtures, whether at or above the mouth of the well (e.g., at the earth's surface either on land or subsea, or at the rig floor 12), or other structures or equipment through which objects can be moved into or out of the well, the movement of which such objects the present invention is intended to detect.

Also illustrated in FIG. 1 is a flow restriction sub 22 connected in the tubing string 20 a selected distance, for example 300 feet, above a plug catcher assembly 24 located at the lower end of the tubing string. An adapter sub 26 and a reverse circulating or jet sub 28 are threadedly connected between the plug catcher sub 24 and the section of tubing 20' that extends upward to the restriction sub 22.

Located above the rig floor 12 for the environment illustrated in FIG. 1, a cement plug launching sub 30, hereinafter referred to as a plug container, is connected to the upper end of the tubing string 20. Also connected to the plug container 30 is a manifold, indicated generally at 32, which has valves V connected to a pump P that supplies fluids under pressure taken from a mixing hopper 34 or the like. The plug container 30 is one type of wellhead fixture at the mouth of the well. This type of wellhead fixture is one that has at least one entry passage into the well or at least one exit passage out of the well. In the case of the illustrated plug container, it provides an entry into the well for the one or more plugs launched from the plug container 30.

Figure 2:
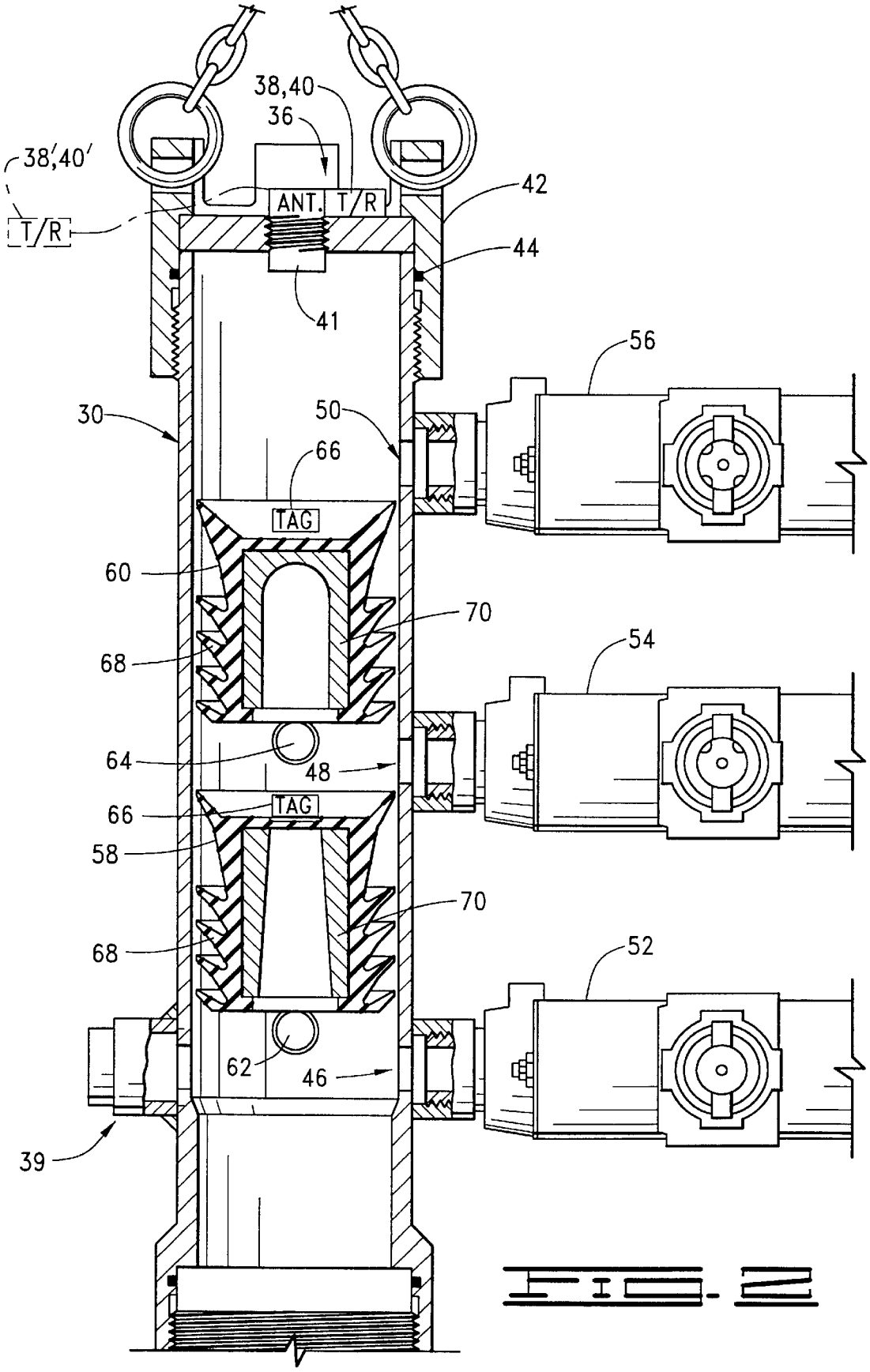
FIG. 2 is a sectional representation of a plug container, identified in FIG. 1, and two cementing plugs therein incorporating the present invention.
Figure 3:
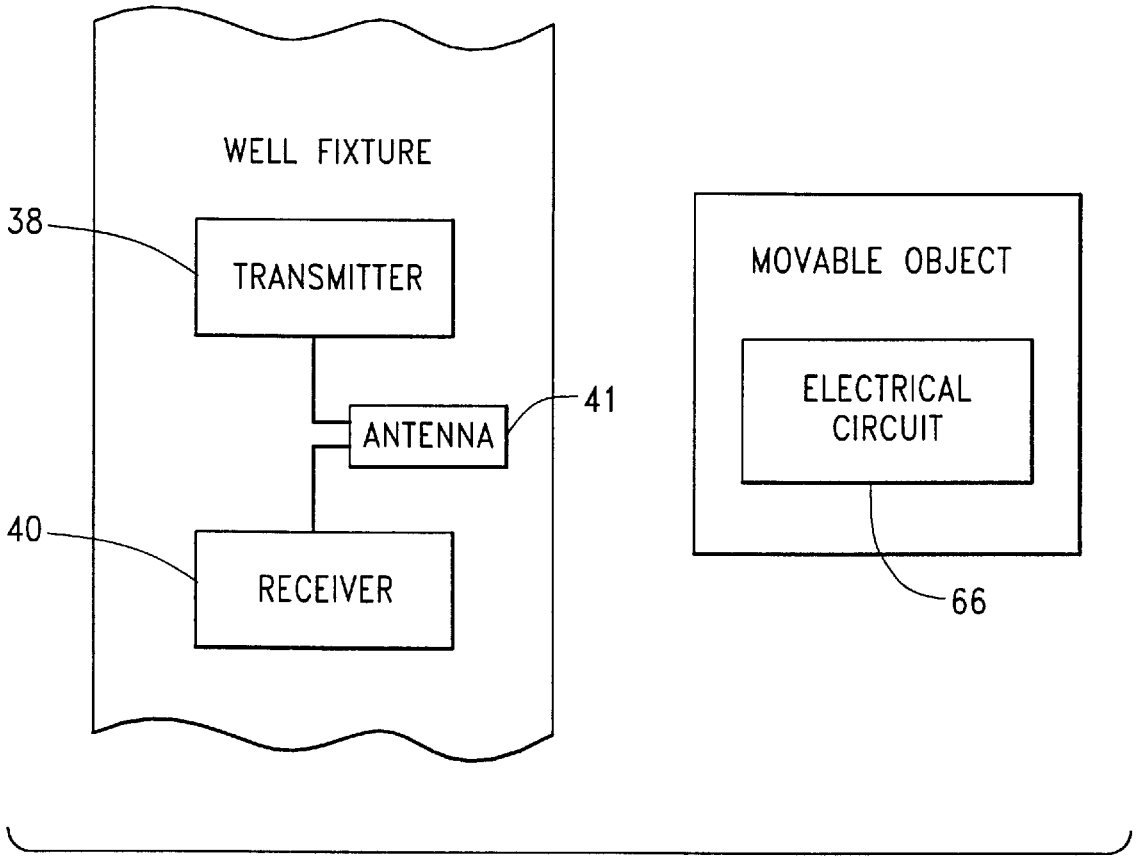
FIG. 3 is a block diagram of a detector apparatus of the present invention.

Also represented in FIG. 1 is part of a detector apparatus of the present invention. This part is illustrated in FIG. 1 merely as a block 36, but it includes a transmitter 38 (at least when passive tag circuits, described below, are used) and a receiver 40 shown in the block diagram of FIG. 3. This part 36 of the detector apparatus of the preferred embodiment of the present invention can be mounted on a well fixture as represented in FIG. 3. The well fixture includes any suitable part of the wellhead fixture(s) or the tubing string in the FIG. 1 illustration. In the specific application of detecting when a cementing plug is released from the plug container 30 for the embodiment of FIGS. 1 and 2, the transmitter 38 and the receiver 40 are mounted on or in the plug container 30 itself (e.g., on the cap or on the exterior side wall of the plug container). These components can, however, be located away from the other equipment shown in FIGS. 1 and 2. For example, they could be several feet (e.g., thirty to forty feet) away but connected to an antenna mounted on the plug container (see the dot-dash depiction of the transmitter 38' and receiver 40' in FIG. 2).

In general, the detector apparatus of the preferred embodiment of the present invention uses an existing technology referred to as radio frequency identification or RFID. Electromagnetic energy is used to remotely read an electronic radio frequency identification "tag" placed on a movable body in order to identify the body. The information that is read can be of any desired type for which a particular implementation is adapted (e.g., an indication that the tag is present, or a unique identity code, or several kilobytes of information).

For the illustrated embodiment, the transmitter 38, which provides the triggering alternating current electromagnetic signal for this embodiment of the detector apparatus and method of the present invention, is disposed outside the conduit of which the plug container 30 is a part in the FIG. 1 environment. As used in this description and in the claims "electromagnetic signal" from the transmitter 38 includes any electromagnetic emission intended to cause the electrical "tag" to respond; this includes, for example, the mere presence of an electromagnetic field and a discrete encoded electromagnetic transmission. An "electromagnetic signal" from a tag is such an emission to which the receiver 40 can respond. Such electromagnetic signal is generated by electricity flow in an electrical circuit (as distinguished from, for example, a magnetic signal or field from a permanent magnet).

Although outside the conduit, the transmitter 38 transmits the triggering signal into the conduit. As illustrated in FIGS. 1 and 2, the transmitter 38 is connected to the plug container 30. Preferably at least an antenna 41 of the transmitter 38 is placed in a side port of the plug container below the cementing plugs, or in a port in the plug container cap 42. The latter positioning is illustrated in FIG. 2, and the former can be implemented through a port 39 (FIG. 2), for example. The antenna is typically connected by wire or other electrical conductor to the remainder of the transmitter. In the illustrated embodiment, the antenna 41 is shared by, and thus electrically connected in, the receiver 40 (and thus the antenna 41 is part of both the transmitter 38 and the receiver 40). The transmitter and receiver can be connected by any suitable means (e.g., by wire or wireless communication) to other equipment, such as controlling, processing, displaying, or reporting equipment, for example.

The receiver 40 is also disposed outside the conduit in the illustrated embodiment. The receiver 40 (or at least the antenna 41 thereof) is connected to the plug container 30 such that the receiver 40 can receive a responsive or self-generated electromagnetic signal from the electrical "tag" circuit. This reception is through the common antenna 41 in the illustrated embodiment.

The transmitter 38, the receiver 40 and the antenna 41 should be suitably packaged for the locations where they are to be used. For example, the antenna 41 as used in FIG. 2 should be potted (molded in a suitable plastic or epoxy) in a housing to protect it from exposure to well fluids, cement, and pressures that can range from a vacuum to several thousand pounds per square inch.

Referring now to FIG. 2, the plug container 30 is shown in greater detail. The illustrated plug container 30 is a conventional type known in the art, but it is modified to accommodate the present invention as described herein (e.g., to have the part 36 mounted on it). The embodiment shown in FIGS. 1 and 2 has two plugs, but a single plug or additional plugs can be used as known in the art. The plug container 30 includes a tubular body threaded at its lower end to connect to the tubing string 20 or some intervening adapter as appropriate. A cap 42 is threaded onto the upper end of the plug container body. An 0-ring seal 44 is used to make the connection fluid-tight. A series of vertically spaced ports 46, 48 and 50 extend through the wall of the body and are connected to respective lines having the valves V (numbered 52, 54 and 56 in FIG. 2). The lines lead to a common trunk which is connected to the outlet of the pump P as depicted in FIG. 1.

Cementing plugs 58, 60 are retained in the plug container 30 by plungers 62, 64, respectively, of conventional plug release plunger assemblies (not otherwise shown). Each plug 58, 60 is typically a conventional plug for separating cement and other fluids which are to be pumped into the well in series, except that each plug includes a respective "tag" electrical circuit 66. In at least a passive type of construction, the circuit 66 responds to an electromagnetic signal from the transmitter 38 when the electrical circuit 66 is in effective proximity of the electromagnetic signal. Each such electrical circuit 66 responds in real time to an externally generated alternating current electromagnetic signal so that the electrical circuit transmits a responsive signal for reception outside the object at the same time as the object moves through the conduit (i.e., for reception by the receiver 40 in the preferred embodiment). In the illustrated embodiment, the electrical circuit 66 is mounted on a respective plug so that the circuit 66 passes in effective proximity to the transmitter 38 and the receiver 40 (or at least the antenna thereof) when the plug is released and dropped or pumped into the well. "Effective proximity" means that the triggering electromagnetic signal from the transmitter 38 can be received by the passing electrical circuit 66 (the term also applies with regard to the responsive or self-generated signal from the electrical circuit 66 on the plug and the receiver 40). Each electrical circuit 66 should be susceptible to being readily drilled out after the cementing job is completed.

Each of the cementing plugs with its respective electrical circuit 66 forms another part of the present invention. In one aspect it is one embodiment of an object to be displaced in an oil or gas well, and as such is an inventive object itself as well as being part of the overall detector apparatus of the present invention. Each of the cementing plugs includes a body that is movable through the conduit of the oil or gas well. Specifically for the illustrated embodiment, it is a body that is movable through the wellhead fixture (namely the plug container 30 in this case) into (or, in other contexts, out of) the well. In the illustrated embodiment, the body can be any type of plug, ball or dart that is to be displaced down the conduit of the well from the surface. Examples include cementing plugs, multiple stage plugs, latch-down plugs, SSR™ plug releasing balls and darts, fill-up and cementing tool system plugs and releasing balls, frac balls and PERFPAC™ balls, each of which is modified to have a "tag" (i.e., an electrical circuit 66) identifying it individually or by function. The tags can also be used to show when objects (e.g., PERFPAC™ balls) have been reverse circulated back up the well. Accordingly, the body of the movable object of the preferred embodiment of the present invention is selected from the group consisting of a movable plug, ball and dart.

There are two basic types of electrical circuits 66 that are used on the movable body. One is referred to as passive and the other as active. The active type is presently preferred because of its longer read range (i.e., it can interact with the part 36—the transmitter and/or receiver—at greater distances than can a passive type). A plug typically has to move several inches to move below a fluid port in the plug container, and so an extended read range gives an indication that the plug has moved well beyond the port.

Passive "tag" circuits 66 have no internal power source, such as a battery. They contain an electromagnetic or electronic coil that can be excited by a particular frequency of electromagnetic energy transmitted from the transmitter 38. The electromagnetic energy transmitted from the transmitter 38 to the coil momentarily excites it (i.e., causes energizing or activating electrical current flow), causing the electrical circuit 66 to transmit the contents of its buffer, such as some pre-stored value unique to that particular object. The passive tag circuit 66 has an unlimited shelf life because there is no internal power source, and passive tags are relatively inexpensive. A possible disadvantage is that the read range with present technology can be limited. The read range also depends on the size of the antenna of the transmitter 38, with greater ranges requiring larger antennas.

Passive type tag equipment can be obtained commercially. Two sources are RFID, Inc. of Aurora, Colo., U.S.A. ($R^3$ product line) and Integrated Silicon Design of Adelaide, South Australia (Tag-Right product line). Examples of specific products include a model 1795 ATS tag and model 5100 antenna and model 400XE combination reader and interface (transmitter/receiver) from RFID, Inc. and a model TC242 tag and model C242 reader from Integrated Silicon Design. This RFID system has a nominal read range of thirteen inches and operates at 148 kilohertz, and this Integrated Silicon Design system has a nominal read range of 25.5 inches and operates at 13.56 megahertz.

The active type of electrical circuit 66 for the movable body can be of the type found in vehicle ID or factory automation applications where read range and speed are concerns. These active tag circuits contain an internal power source, typically a long life battery, which gives the circuit a much farther reading range and faster speed. Without implying any limitation as to what features a passive circuit might have, the active tag can have a read and write capability, allowing its internal operating program and other information to be remotely updated or changed as required. The active tag's memory can store information (e.g., several kilobytes) and a control transmitter can write to such a tag circuit from greater distances (e.g., fifteen meters). Information that could be stored in the active tag for future recall includes, for example, serial numbers, lot numbers, build dates, and expiration dates. Additionally, an active tag can be designed to transmit without initiation by the transmitter 38 (e.g., the tag self-generates—that is, under its own power and circuit design or programmed control—an identifying electromagnetic signal), and so in some implementations the transmitter 38 need not be used and can be omitted.

Active type tag equipment can be obtained commercially. Two sources are Texas Instruments of Dallas, Tex., U.S.A. (TIRIS product line) and Identec of Kelowna, British Columbia, Canada (i-Q product line). Examples of specific products include a model 9795101-001 tag and model 5000 reader system from Texas Instruments and a model I-QR tag and model ILR-CARD reader from Identec. This Texas Instruments system has a nominal read range of 96 inches and operates at 134.2 kilohertz, and this Identec system has a nominal read range of 394 inches and operates at 915 or 868 megahertz.

For at least some systems, the tags should be placed in fluid-tight and pressure-tight packaging to withstand exposure to well fluids, cement, and pressures that can range from a vacuum to several thousand pounds per square inch.

The respective electrical circuit 66 can be attached to the object by any suitable connecting means or methods. With regard to a cementing plug, for example, it can be attached by any of several methods, including molding it in the rubber portion 68 of the plug or the plastic insert 70, attaching it to the surface of the cementing plug with an adhesive or by mechanical means (e.g., screws, nails, or staples), or placing the circuit in a cavity in the cementing plug. The tag circuit can have an identification code unique to that individual object, or to that type of object, such as top cementing plug or bottom cementing plug. This code then identifies which plug has left the plug container and which is remaining in that particular implementation. Other information can also be available. Depending on the type of circuit 66 and antenna or control transmitter 38, the tags can be read continuously or intermittently when within effective proximity of the antenna. If read continuously, the loss of signal indicates the object is gone. Some systems may also be able to measure signal strength to determine how far the object has moved until it is out of range. For backup, two or more tags can be placed on each body in case one fails.

For the environment depicted in FIG. 1, the plug container 30 is used in a conventional manner; however, release of the plugs 58, 60 is sensed in accordance with the present invention. Each plug is used by being released adjacent a fluid to separate the fluid from a leading or trailing different stage or type of fluid. Referring to FIG. 2, the plug 58 can be used to separate a cement slurry from a leading drilling mud pumped ahead of the plug 58. The plug 60 can be released behind the cement slurry to separate it from a following mud slurry pumped behind the plug 60 to drive the cement slurry down the tubing 20, around the lower end of the tubing 20 and up the annulus between the tubing 20 and the wall of the well borehole or an outer casing so that the cement slurry can bond the requisite portion of the tubing 20 in the well. This procedure is done in a manner known in the art (e.g., the slurries are sequentially pumped into the tubing through inlet valves 52, 54, 56, and the plugs are released by retracting plungers 62, 64).

If the cement slurry is properly placed in the annulus, the leading and trailing plugs 58, 60 will be at or below the lower end of the tubing 20 because they drop out or land at this point and are not pumped up into the annulus. Once the cement slurry has set so that the tubing is held in place, a drill string (not shown) is typically lowered back into the well to drill the borehole deeper. This necessitates drilling out the plugs 58, 60 that have dropped out in known manner during the fluid placement procedure. If the plugs, or elements added thereto, are of too hard material, this further drilling can be impeded because the material dulls or damages the cutting or crushing surfaces of the drill bit; therefore, readily drillable material is preferably used.

To assist the proper placement of the cement slurry in the oil or gas well by detecting whether each plug has properly released into the fluid stream, the present invention provides a method of detecting an object moving in a conduit of an oil or gas well. This method includes moving an object in the well. In the illustrated system, this specifically includes injecting a cementing plug into the well through the cementing plug container to provide the object moving in the conduit such as described above. In at least a passive tag system, the method further comprises providing a triggering electromagnetic signal from outside the object moving in the conduit of the oil or gas well. Providing a triggering electromagnetic signal includes transmitting the triggering electromagnetic signal from a selected location on a wellhead fixture at the mouth of the well in the illustrated preferred embodiment. The method further comprises generating, from an electrical circuit on the object moving in the conduit responding to the triggering electromagnetic signal, a responsive electromagnetic signal; and detecting the responsive electromagnetic signal away from the moving object.

The method of the present invention can also be defined as comprising generating an electromagnetic signal from an electrical circuit on a plug moving in a plug container and detecting the electromagnetic signal away from the moving plug. The electromagnetic signal can be self-generated by an active tag circuit, or it can be responsively generated in response to a signal from the transmitter disposed away from the plug.

All of these steps of the method can be performed in the manner described above, or apparent therefrom, regarding the object and detector apparatus of the present invention; and the method can be otherwise defined in accordance with such explanation.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. An object to be displaced in an oil or gas well, comprising:

a body movable through a conduit of an oil or gas well; and an electrical circuit connected to the body, the electrical circuit responsive to an externally generated alternating current electromagnetic signal such that the electrical circuit transmits a responsive electromagnetic signal for reception outside the object as the object moves through the conduit.

2. An object to be displaced in an oil or gas well as defined in claim 1, wherein the body is selected from the group consisting of a movable plug, ball and dart.

3. Detector apparatus for an oil or gas well, comprising:

a body selected from the group consisting of a moveable plug, ball and dart movable through a conduit of an oil or gas well;

an electrical circuit carried by the body, wherein the electrical circuit transmits an electromagnetic signal for reception away from the body as the body moves through the conduit; and a receiver disposed relative to the conduit and the body to receive the electromagnetic signal from the electrical circuit.

4. Detector apparatus for an oil or gas well as defined in claim 3, wherein the receiver includes an antenna mounted through the conduit.

5. Detector apparatus for an oil or gas well as defined in claim 3, further comprising a transmitter disposed relative to the conduit and the body to transmit into the conduit an alternating current electromagnetic signal, wherein the electrical circuit transmits its electromagnetic signal in response to the alternating current electromagnetic signal from the transmitter.

6. Detector apparatus for an oil or gas well as defined in claim 5, wherein the transmitter and the receiver include a common antenna mounted through the conduit.

7. Detector apparatus for an oil or gas well having a wellhead fixture at the mouth of the well, wherein the wellhead fixture has at least one entry passage into the well or at least one exit passage out of the well, comprising:

a body movable through the wellhead fixture into or out of the oil or gas well;

a transmitter connected to the wellhead fixture to transmit into the wellhead fixture an alternating current electromagnetic signal;

an electrical circuit connected to the body, the electrical circuit responsive to the alternating current electromagnetic signal when the body is in the wellhead fixture such that the electrical circuit transmits a responsive electromagnetic signal for reception outside the body as the body moves in the wellhead fixture; and a receiver connected to the wellhead fixture to receive the responsive signal from the electrical circuit.

8. Detector apparatus for an oil or gas well as defined in claim 7, wherein the body is selected from the group consisting of a movable plug, ball and dart.

9. Detector apparatus for an oil or gas well as defined in claim 7, wherein the wellhead fixture includes a plug container and the body is a cementing plug injectable into the well through the plug container.

10. Detector apparatus for an oil or gas well as defined in claim 9, wherein the transmitter and the receiver include a common antenna connected through the plug container.

11. Detector apparatus for an oil or gas well having a wellhead fixture at the mouth of the well, wherein the wellhead fixture has at least one entry passage into the well or at least one exit passage out of the well, comprising:

a body selected from the group consisting of a moveable plug, ball and dart movable through the wellhead fixture into or out of the oil or gas well;

an electrical circuit carried by the body, wherein the electrical circuit transmits an electromagnetic signal for reception outside the body as the body moves in the wellhead fixture; and a receiver connected to the wellhead fixture to receive the electromagnetic signal from the electrical circuit.

12. Detector apparatus for an oil or gas well as defined in claim 11, wherein the wellhead fixture includes a plug container and the body is a cementing plug injectable into the well through the plug container.

13. Detector apparatus for an oil or gas well as defined in claim 12, wherein the transmitter and the receiver include a common antenna connected through the plug container.

14. A method of detecting an object moving in a conduit of an oil or gas well, comprising:

providing a triggering electromagnetic signal from outside an object moving in a conduit of an oil or gas well;

generating, from an electrical circuit on the object moving in the conduit responding to the triggering electromagnetic signal, a responsive electromagnetic signal; and detecting the responsive electromagnetic signal away from the moving object.

15. A method as defined in claim 14, wherein providing a triggering electromagnetic signal includes transmitting the triggering electromagnetic signal from a selected location on a wellhead fixture at the mouth of the well.

16. A method as defined in claim 15, wherein the wellhead fixture is a cementing plug container.

17. A method as defined in claim 16, further comprising injecting a cementing plug into the well through the cementing plug container to provide the object moving in the conduit.

18. A method of detecting a plug moving in a plug container of an oil or gas well, comprising:

generating an electromagnetic signal from an electrical circuit on the plug moving in the plug container; and detecting the electromagnetic signal away from the moving plug.

19. Detector apparatus for an oil or gas well having a plug container that connects at the mouth of the well to a tubing string extending in the well, comprising:

a movable plug disposed in the plug container such that the plug is pumpable into the tubing string from the plug container;

an electrical circuit carried by the plug, wherein the electrical circuit provides at least one of a self-generated electromagnetic signal or a responsive electromagnetic signal;

an antenna mounted on the plug container so that an electromagnetic signal can be transmitted from the antenna to the electrical circuit or received by the antenna from the electrical circuit; and a receiver connected to the antenna so that the receiver detects reception by the antenna of the self-generated or responsive electromagnetic signal from the electrical circuit when the plug is within an effective proximity of the antenna.

20. Detector apparatus as defined in claim 19, further comprising a transmitter connected to the antenna so that a transmission of an electromagnetic signal by the transmitter through the antenna causes the electrical circuit to provide the responsive electromagnetic signal when the plug is within the effective proximity of the antenna.

* * * * *